United States Patent [19]

Link

[11] 4,255,744

[45] Mar. 10, 1981

[54] HIGHWAY CROSSING BELL APPARATUS

[75] Inventor: Charles T. Link, Pleasant Hills, Pa.

[73] Assignee: American Standard Inc., Swissvale, Pa.

[21] Appl. No.: 47,532

[22] Filed: Jun. 11, 1979

[51] Int. Cl.[3] ..... G10K 1/065

[52] U.S. Cl. ..... 340/399; 340/396; 340/392

[58] Field of Search ..... 340/396, 399, 390; 84/103; 116/155

[56] References Cited

U.S. PATENT DOCUMENTS

| | | | |
|---|---|---|---|
| 956,250 | 4/1910 | Wilson | 340/392 UX |
| 1,117,484 | 11/1914 | Dunham | 340/392 UX |
| 1,136,781 | 4/1915 | Elliott | 340/399 |
| 3,689,919 | 9/1972 | Ganter | 340/396 |
| 3,769,870 | 11/1973 | Huber | 340/399 |
| 3,910,225 | 10/1975 | Huber | 84/103 |

FOREIGN PATENT DOCUMENTS

| | | | |
|---|---|---|---|
| 198688 | 12/1964 | Sweden | 340/390 |

*Primary Examiner*—Harold I. Pitts

*Attorney, Agent, or Firm*—A. G. Williamson, Jr.; R. W. McIntire, Jr.

[57] ABSTRACT

The bell clapper arm is mounted on the rotatable armature of a rotary solenoid so as to be moved through an arc, to strike the bell gong with a hammer at its outer end, each time the solenoid is energized. The solenoid energizing circuit includes the contacts of a reed relay switch which are periodically closed by a permanent magnet rotated in close proximity by a motor actuated when a bell warning is desired. The reed relay contacts are closed by the passage of each pole of the magnet and the ringing frequency is adjusted by varying the motor speed.

4 Claims, 1 Drawing Figure

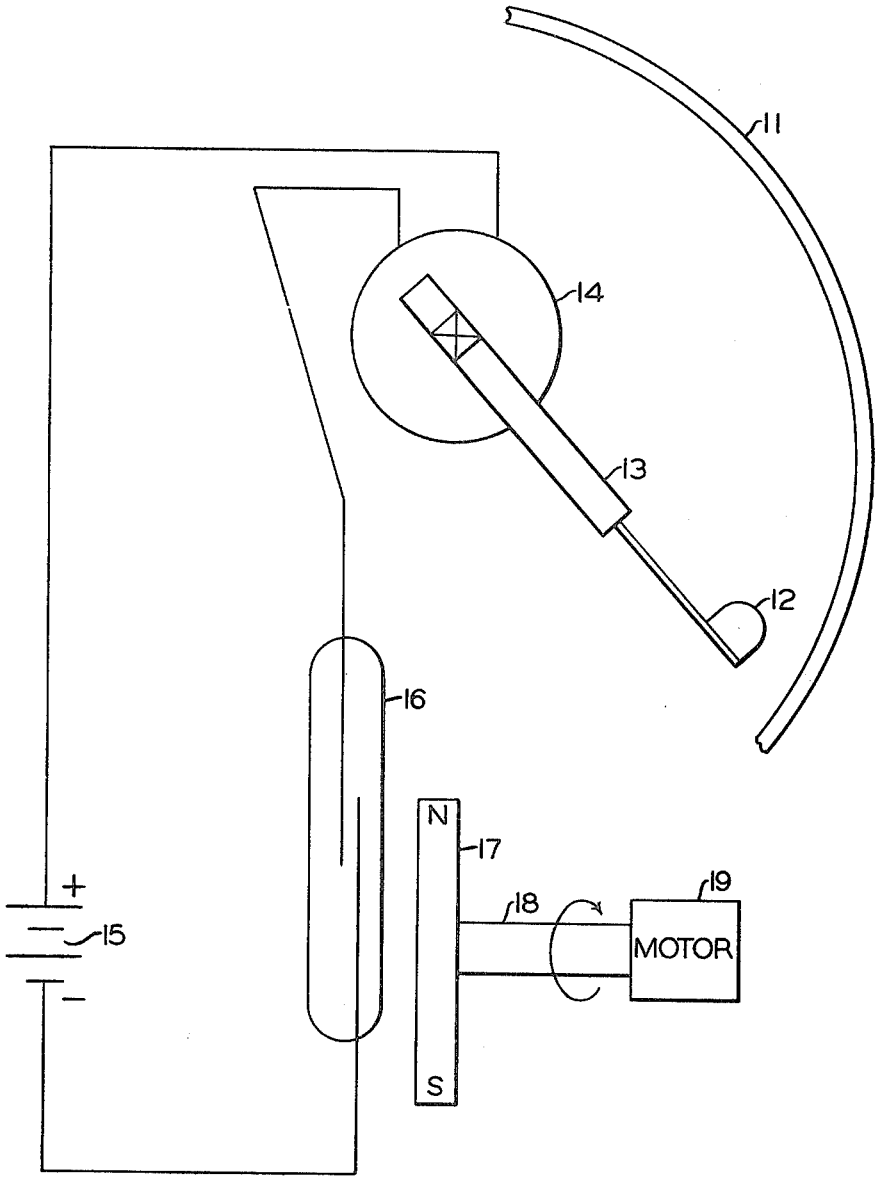
11
14
13
12
16
N
17
S
18
19
MOTOR
+
15
−

HIGHWAY CROSSING BELL APPARATUS

BACKGROUND OF THE INVENTION

My invention pertains to highway crossing bell apparatus. More specifically, the invention relates to clapper actuating apparatus, for a crossing warning bell, using a rotary solenoid and a reed relay switch.

The drive or operating apparatus on most existing crossing warning bells includes coil magnets and contact structure to make and break the magnet energizing circuits to drive the clapper arm to repeatedly strike the gong to sound the bell. The drive connections to the clapper arm require levers and pivot arms with pins and bearings. Such apparatus arrangements are bulky and require relatively large housings. These arrangements also require considerable preventative maintenance, particularly contact adjustment and lubrication of the pins and bearings. Even with maintenance, the latter elements eventually wear sufficiently to require replacement. Apparatus which eliminates much of the adjustment, lubrication, and wear of moving parts will thus provide distinct advantages.

Accordingly, an object of my invention is an improved crossing bell requiring less maintenance and part replacement.

Another object of the invention is bell apparatus of reduced size and with fewer moving parts, thus requiring smaller housing and less maintenance.

Still another object of the invention is crossing bell apparatus in which the actuating switch contacts are operated without physical contact between the contacts and the actuating mechanism.

A further object of my invention is bell apparatus in which the clapper is actuated to strike the gong element by a periodically energized rotary solenoid.

Yet another object of the invention is bell apparatus in which the periodic operation of the clapper is controlled by a reed relay switch actuated by a rotating permanent magnet.

A still further object of the invention is crossing bell apparatus in which a rotary solenoid, periodically energized by the closing of its actuating circuit over reed relay contacts cycled by an adjacent rotating permanent magnet, repeatedly drives an attached clapper arm through a limited arc to strike the bell gong.

Other objects, features, and advantages of the invention will become apparent from the following specification and appended claims, when taken with the accompanying drawing.

SUMMARY OF THE INVENTION

According to the invention, the bell clapper arm is mounted to be operated by a rotary solenoid. Each time the solenoid is energized, the clapper arm is rotated through a predetermined arc so that a hammer on its outer end strikes the bell gong. The solenoid is energized from an energy source over a circuit including contacts of a reed relay switch. These contacts are periodically closed by a permanent magnet rotated in close proximity to the reed relay by a variable speed motor. This motor is energized by external control means to operate only when ringing of the bell is desired, the speed being preadjusted to provide the desired ringing frequency. Thus, when the motor is turned on, the rotary solenoid is intermittently energized through the reed relay contacts to periodically drive the clapper arm against the gong so that the bell sounds a warning indication.

BRIEF DESCRIPTION OF THE DRAWINGS

Before defining the invention in the appended claims, I shall describe a specific arrangement embodying the invention, as illustrated in the accompanying drawing which is principally a diagrammatic showing of the novel bell apparatus but also including the bell operating circuit.

DETAILED DESCRIPTION OF THE ILLUSTRATED EMBODIMENT

Referring to the single drawing, a portion 11 of a bell gong is illustrated. Conventionally, the full gong element, as in a highway crossing warning bell, for example, has a domed circular shape and is made of steel so as to resonate, i.e., sound an audible tone, when struck by a hammer 12 mounted at one end of a clapper arm 13. Arm 13 is mounted on or connected to the rotatable armature of a rotary solenoid device conventionally illustrated by the circle 14. When the winding of solenoid 14 is energized, arm 13 is operated, i.e., rotated, through an arc so that hammer 12 strikes gong 11.

The winding of solenoid 14 receives energy from a direct current source, e.g., battery 15, over a circuit including the normally open contacts of a reed relay switch 16. These contacts of relay 16 are briefly closed to complete the circuit by the close passage of either pole of a permanent magnet bar 17, whose poles are conventionally designated by the symbols N and S. This magnet bar is mounted on the shaft 18 of a motor 19 (conventionally shown) so as to rotate, as designated by the circular arrow symbol, in close proximity to the relay contacts when the motor operates. The motor is controlled by a selected actuating means so as to operate when a warning bell signal is desired. For example, when the bell is used for a railroad highway crossing warning signal, the motor operates when an approaching train is detected. The speed of the motor may be varied in any known manner to obtain the desired frequency for the ringing signal.

Summarizing the operation briefly, when motor 19 is activated by the associated control means, magnet 17 is rotated by shaft 18 in close proximity to the contacts of relay 16. This causes the contacts to alternately close and open with two cycles of closure for each rotation of the magnet, i.e., once for each pole. Each closing of the contacts energizes solenoid 14 which, in turn, rotates clapper 13 to strike gong 11 with hammer 12. Each subsequent opening of the contacts deenergizes solenoid 14, allowing clapper arm 13 to fall back to its normal position. Since solenoid 14 is periodically energized as the permanent magnet rotates, hammer 12 of the clapper periodically strikes gong 11 to create a continuous bell ringing sound to provide a warning indication or signal. If desired, a contact controlled by the motor actuating device may be inserted in series with battery 15 to interrupt the energization of the solenoid winding in the event the relay contacts should remain closed, under the influence of the magnet, when motor operation ceases.

The arrangement of my invention thus provides bell apparatus of simple design. There is no direct attachment between the switch contacts and the control means, i.e., the magnet. This eliminates the necessity for contact adjustment. Since there is also a minimum number of wear points requiring lubrication, overall maintenance is further reduced. The smaller mechanism requires less housing space. The desired cyclic ringing rate or frequency is selected by adjustment of the motor speed. An efficient and economic bell apparatus results.

Although I have herein shown and described but a single bell apparatus arrangement embodying the invention, it is to be understood that various changes and modifications therein, within the scope of the appended claims, may be made without departing from the spirit and scope of the invention.

Having now described the invention, what I claim as new and desire to secure by Letters Patent, is:

1. Bell apparatus comprising, (a) a circular gong for sounding a signal when struck, (b) a clapper means, (c) an operating means connected for rotating said clapper means to strike said gong when said operating means is actuated, (d) a reed relay switch having an enclosed pair of contacts coupled for actuating said operating means when closed.

(e) a motor operable when selectively activated for rotating its shaft, and (f) a permanent magnet mounted on said motor shaft and positioned in proximity to said reed relay for repeatedly actuating closure of said pair of contacts when said magnet is rotated by operation of said motor.

2. Bell apparatus as defined in claim 1, which further includes, (a) a source of operating energy for said apparatus, and in which, (b) said operating means is a rotary solenoid periodically energized from said source by the repeated closing of said reed relay switch contacts, and (c) said clapper means includes, (1) a clapper arm connected at one end to the rotatable armature of said solenoid and movable through a predetermined arc each time said solenoid is energized, and (2) a hammer element connected at the other end of said arm for striking said gong when said arm is moved through said arc.

3. Operating apparatus for a bell, which includes a circular gong device for sounding a tone each time it is struck, comprising, (a) a clapper arm with a hammer mounted at one end for at times striking said gong to sound the tone, (b) a rotary solenoid connected for rotating said clapper arm to strike said gong each time said solenoid is energized, (c) a source of energy for energizing said solenoid when connected thereto, (d) a reed switch means coupled for connecting said source to said solenoid when the switch is operated, and (e) a rotating permanent magnet positioned for periodically operating said switch means to energize said solenoid.

4. Bell operating apparatus as defined in claim 3 which further includes, motor means connected to said permanent magnet and selectively actuated for rotating said magnet when bell operation is desired.

* * * * *